US005531045A

United States Patent [19]

Piltingsrud

[11] Patent Number: 5,531,045

[45] Date of Patent: Jul. 2, 1996

[54] AUTOMATIC WINDOW SASH AND LOCK OPERATOR

[75] Inventor: Stephen M. Piltingsrud, Owatonna, Minn.

[73] Assignee: Truth Hardware Corporation, Owatonna, Minn.

[21] Appl. No.: 414,917

[22] Filed: Mar. 31, 1995

[51] Int. Cl.[6] ..... E05F 11/02

[52] U.S. Cl. ..... 49/279; 49/341; 49/345

[58] Field of Search ..... 49/279, 280, 345, 49/346, 341, 340, 339

[56] References Cited

U.S. PATENT DOCUMENTS

| | | | |
|---|---|---|---|
| 1,724,011 | 8/1929 | Flagg | 49/341 X |
| 2,538,980 | 1/1951 | Payne, Jr. | 49/280 |
| 5,054,239 | 10/1991 | Tucker et al. | 49/279 |
| 5,111,615 | 5/1992 | Kuhnt et al. | 49/279 |
| 5,152,103 | 10/1992 | Tucker et al. | 49/279 |

*Primary Examiner*—Philip C. Kannan

*Attorney, Agent, or Firm*—Wood, Phillips, VanSanten, Clark & Mortimer

[57] ABSTRACT

A window operator and lock structure for controlling a window sash relative to a window frame, including a drive input securable to a frame and engaging both an operator linkage securable to a window sash to effectuate motion of a secured sash relative to a frame, and a lock linkage securable to a lock structure for locking a secured sash to a frame. A link in the lock linkage moves in a generally longitudinal direction when operating the lock structure and includes a substantially transverse slot. A cam is pivotable about a cam axis fixed relative to the frame and includes a member receivable in the link slot to block operation of the lock linkage. The sash when closed against the frame includes a member engaging the cam to pivot the cam in a first direction moving the cam member clear of the link slot. The cam is blocked from pivoting when the sash is closed by engagement of the cam member with a side surface of the lock linkage link. The cam blocks the sash member from moving toward opening of the sash when the cam is positioned with the cam member clear of the link slot.

26 Claims, 4 Drawing Sheets

FIG. 1
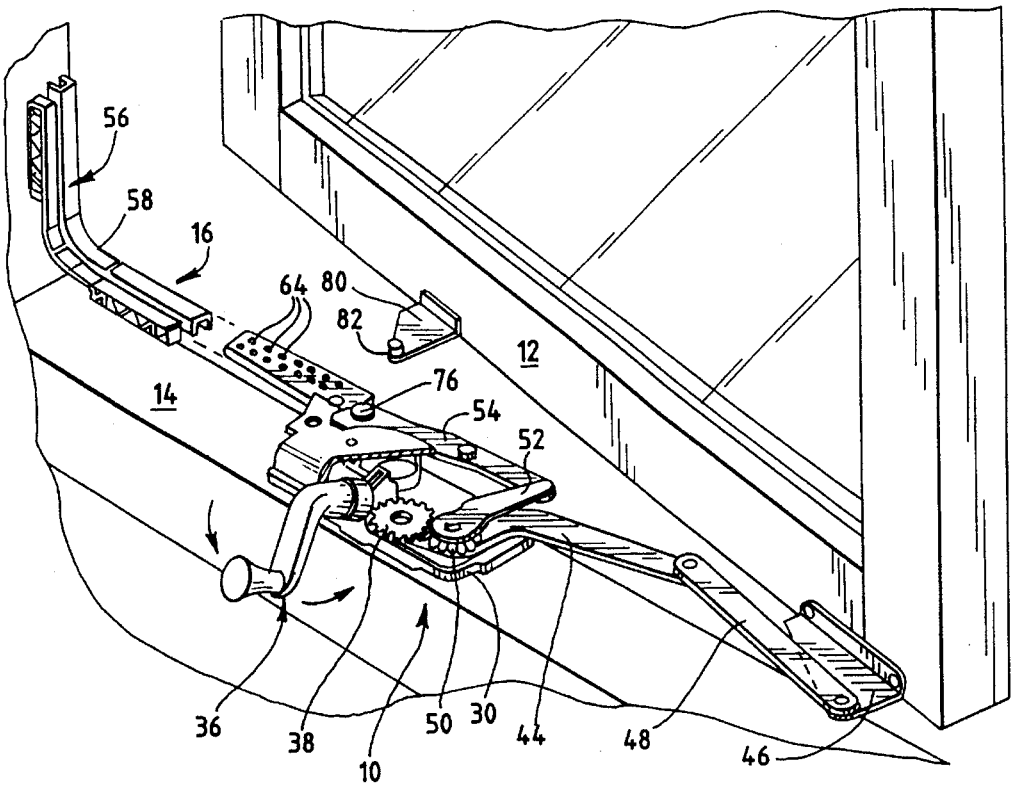
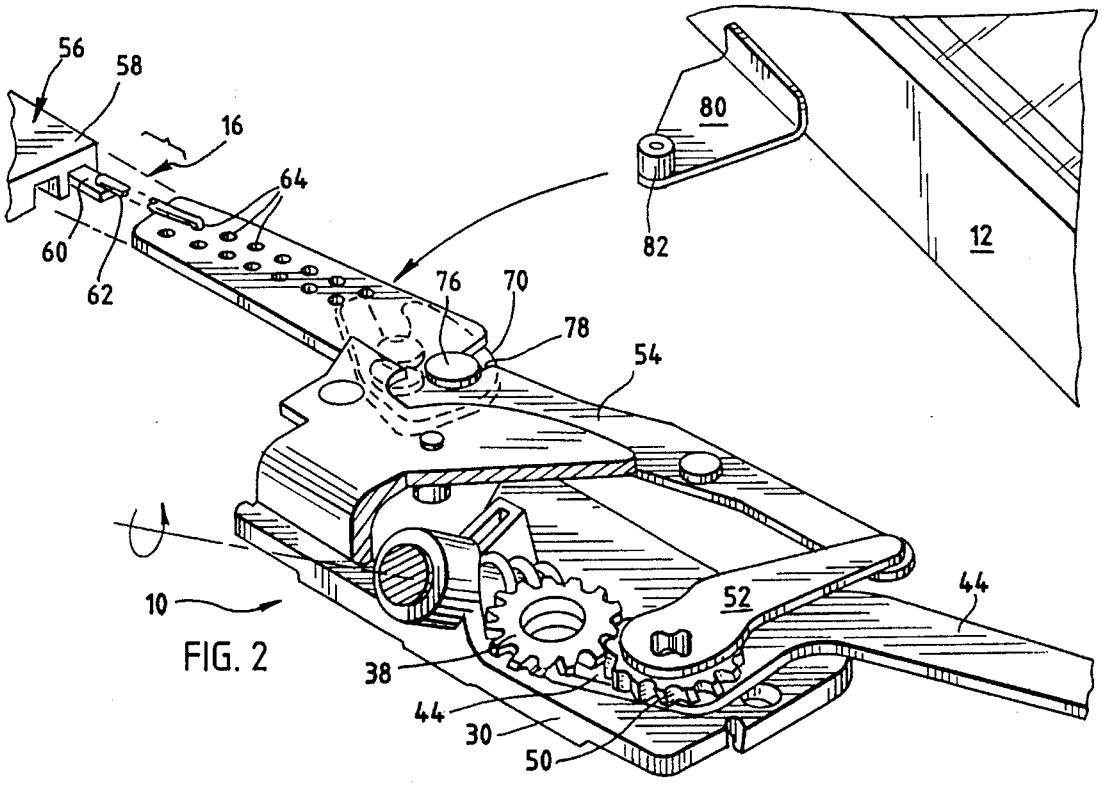
FIG. 2

AUTOMATIC WINDOW SASH AND LOCK OPERATOR

BACKGROUND OF THE INVENTION

1. Technical Field

The present invention is directed toward mechanical window operators, and more particularly toward operators for controlling movement and locking of casement or awning type windows.

2. Background Art

Casement and awning type windows are well known in the art in which a window sash pivots about one of its sides for opening and closing relative to a window frame on which it is supported. Many different types of window (and other closure) operators which are well known in the art for accomplishing this operation.

Of course, it is also usually desirable to also provide a positive mechanical locking connection between the sash and the frame to provide security against the sash being forced open by an intruder trying to gain entry. Unfortunately, with many window operators, the lock structure is completely separate from the operator, with the result sometimes being that the person manipulating the operator to close the window inadvertently fails to also positively lock the window.

Accordingly, some operators have been constructed so that manipulation of the operator structure will automatically sequentially operate the locking structure as well.

Examples of such operators are shown, for example, in Tucker et al. U.S. Pat. No. 5,152,103, Tucker et al U.S. Pat. No. 4,937,976, Vetter U.S. Pat. No. 4,497,135, Payne U.S. Pat. No. 2,538,980, and Flagg U.S. Pat. No. 1,724,011.

For example, Flagg U.S. Pat. No. 1,724,011 uses a rack with a slot and pin arrangement to selectively operate either the window sash or the locking structure. Tucker et al. U.S. Pat. No. 4,937,976 discloses an operator structure in which a handle is rotated to control movement of a sash, with the handle also being pivotable between active and inactive positions where such separate pivoting operates a locking mechanism for the window.

Vetter U.S. Pat. No. 4,497,135 discloses an automatic operator and locking mechanism in which separate gear drives on a corner of the sash are provided connecting an electric drive motor to the sash operator and lock mechanism, respectively, with a sash operated trigger restraining the lock mechanism against operation when the sash is open.

Tucker et al, U.S. Pat. No. 5,152,103 is a combination operator and lock which has been found to meet the desirable characteristics of such structures. That is, it is simple to use not only when opening and closing the window, but also reliably ensures that the window automatically and properly unlocks and locks as it is opened and closed. Further, the Tucker et al. '103 structure is readily usable in any number of different configurations to provide whatever type of window operation is desirable.

One problem which has been found with the Tucker et al. '103 structure is that, during the short transition period during closing when the drive is disconnecting from the operator portion and connecting to the locking portion, the operation of the structure becomes indeterminate. That is, two different motions (of both the locking structure and the operating structure) are possible though only motion of the locking structure is desired. As a result, it is at least possible during such transition period that the sash would open whereby it would not be properly positioned for engagement by the locking structure as the locking motion proceeds. If that occurs (and it is a distinct possibility in cases where there is a pressure drop from the interior of the dwelling to the exterior, such pressure drop tending to constantly bias the sash toward opening), the structure must be manually reset. Further, if this failure to properly lock were not noticed by the dwelling occupant, it could present a dangerous false sense of security as a result of such occupant's erroneous belief that the sash is locked shut.

The present invention is directed toward solving the above prior art problems.

SUMMARY OF THE INVENTION

In one aspect of the present invention, a window operator and lock structure for controlling a window sash relative to a window frame is provided, including a drive input securable to a frame and engaging both an operator linkage securable to a window sash to effectuate motion of a secured sash relative to a frame, and a lock linkage securable to a lock structure for locking a secured sash to a frame. A link in the lock linkage moves in a generally longitudinal direction when operating the lock structure and includes a substantially transverse slot. A cam is pivotable about a cam axis fixable relative to the frame and includes a member receivable in the link slot to block operation of the lock linkage. The sash when closed against the frame includes a member engaging the cam to pivot the cam in a first direction moving the cam member clear of the link slot. The sash member is blocked to prevent opening of the sash when the cam member is clear of the link slot.

In a preferred form of the present invention, the cam is biased in a direction opposite the first direction.

In another preferred form of the present invention, the cam is blocked from pivoting in a direction opposite the first direction when the cam member is clear of the link slot, and the cam blocks the sash member from moving toward opening the sash when the cam is positioned with the cam member clear of the link slot.

In still another preferred form of the present invention, the cam is blocked from pivoting when the sash is closed by engagement of the cam member with a side surface of the longitudinal link.

In yet another preferred form of the present invention, the sash member is a trip member projecting toward the cam from the sash and the cam includes a slot receiving the trip member when the sash is substantially closed against the frame and substantial movement of the trip member received in the slot pivots the cam.

In a related aspect of the present invention, a window operator and lock structure for controlling a window sash relative to a window frame is provided, including a drive input securable to a frame and operably connected to both an operator linkage controlling movement of a sash relative to a frame and a lock linkage controlling operation of a lock structure for locking the sash to the frame. Structure for automatically restraining one linkage for selective driving of the other linkage during driving includes a lock linkage link with a transverse slot, a pivotable cam including a member receivable in the link slot to block operation of the lock linkage, a sash member engaging the cam when the sash is closed to pivot the cam to move the cam member clear of the link slot, where the sash member is blocked from moving toward opening of the sash when the cam member is clear of the link slot.

In another aspect of the present invention, the drive input drives a sun gear and a planet gear is rotatable about a planet gear axis and supported for pivoting about the sun gear, where the operator linkage is secured at one end to the planet gear axis and the lock linkage includes a gear arm fixed to the planet gear.

It is an object of the present invention to provide an operator which can be inexpensively manufactured and installed.

It is a further object of the present invention to provide an automatic window operator and locking mechanism which may be conventionally mounted centrally on the frame for easy access for manual operation.

It is another object of the present invention to provide an operator which can be easily operated and at the same time provide reliable and foolproof locking.

It is still another object of the present invention to provide an automatic window operator and locking mechanism which has an aesthetically pleasing appearance when installed.

BRIEF DESCRIPTION OF THE DRAWINGS

FIG. 1 is a perspective view of a window frame and sash including the sash and lock operator of the present invention showing the window sash in an open position;

FIG. 2 is an perspective view similar to FIG. 1, illustrating the sash and lock operator including the hidden cam shown in broken lines;

DESCRIPTION OF THE PREFERRED EMBODIMENT

Figure 3:
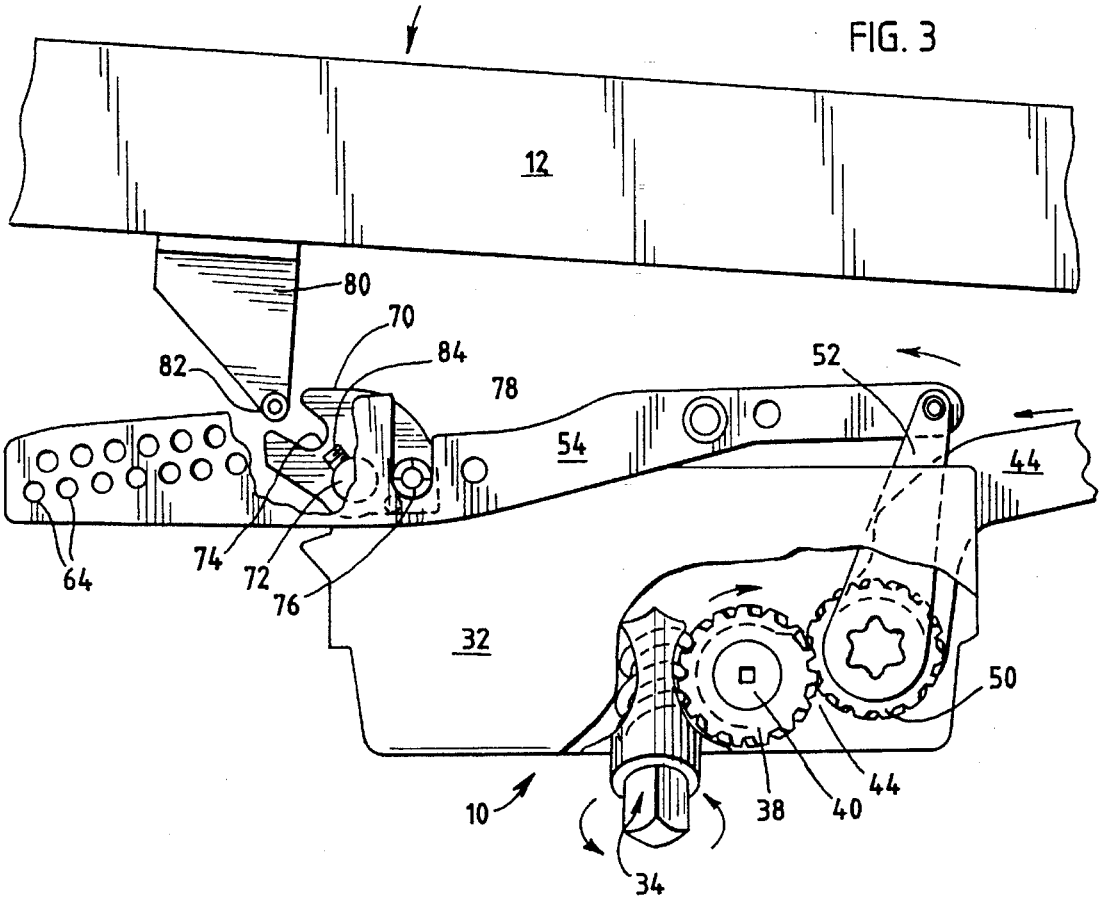
FIG. 3 is a partially broken plan view of the sash and lock operator as the window sash approaches a closed position.

The operator of the present invention represents an improvement upon the operator disclosed in Tucker et al, U.S. Pat. No. 5,152,103, issued Oct. 6, 1992, the complete disclosure of which is hereby incorporated by reference.

FIG. 1 illustrates the operator 10 of the present invention, which operator 10 both controls pivoting of a window sash 12 relative to a window frame 14, and controls operation of a mechanism 16 for locking the sash 12 to the frame 14.

The sash 12 is supported on the frame 14 by a suitable hinge structure (not shown), such as a casement hinge including a track suitably secured to the frame, which track guides a slidable shoe pivotally connected to a support arm attached to the bottom of the sash. Such sashes are known, and operate to provide a "washability" configuration when the window is opened (washable in the sense that a person can readily reach both sides of the window for washing when desired). Still other suitable support hinge structures usable with the present invention will be apparent to a person of ordinary skill who has obtained an understanding of the present invention.

Referring now to the operator 10, a base 30 is suitably secured to the frame 14, as by screws (not shown). The base 30 may be centrally located on the bottom side of the frame 14 as is preferable, as this is not only common for casement window operators but it also ensures that a person turning the operator 10 will not be restricted (or scrape their knuckles) by the sides of the frame 10.

The operator 10 may also be provided with a suitable cover 32. Though shown only generally in FIGS. 3–7 without aesthetic detail, such cover 32 is preferably provided with an aesthetically pleasing appearance. Further, as will become apparent, the components of the operator 10 require minimal space throughout the range of motion during operation, and therefore covers such as heretofore used by window operator manufacturers can typically be used with this operator. This is an important factor to those manufacturers which have important trademark and trade dress rights in their covers (for example, where a manufacturer uses a common cover design with different operators and the cover design is recognized in the market as an indication of the source of the operators).

Suitably supported on the base 30 is a worm drive 34 (see FIG. 3) to which a rotatable handle 36 (see FIG. 1) is suitably mounted. A sun gear 38 is rotatably supported on the base 30 about a suitable pin 40 defining a sun gear axis. The sun gear 38 meshes with the worm drive 34 so that clockwise rotation of the handle 36 (for opening the sash 12) causes the sun gear 38 to rotate counterclockwise.

A pull link 44 is suitably secured relative to the pin 40 for pivoting about the same axis as the sun gear 38. As shown in FIG. 1, a bracket 46 is secured to the inside of the window sash 12 and is connected to the pull link 44 by a drag link 48 to operably connect the operator 10 to the sash 12.

The pull link 44 also pivotably supports a planet gear 50 which meshes with the sun gear 38, and a gear arm 52 is suitably secured to the planet gear 46 for pivoting therewith. A cam link 54 connects the gear arm 52 to the locking mechanism 16 (see FIGS. 1–2).

It will be understood by those skilled in the art, once an understanding of the present invention is obtained, that a wide variety of locking mechanisms 16 could be used in connection with the present invention. A preferred mechanism 16 includes a suitable around-the-corner (ATC) mechanism 56, such as a 90° corner guide track 58 for a suitable (non-compressible) strap 60 (see FIG. 2) secured on one end to an operator tie bar 62 and on the other end to a vertical lock tie bar supporting one or more rollers or keepers, with the non-supported keepers or rollers secured to the sash 12. Such keepers can include a ramped portion, and can further be spaced from one another slightly less than the rollers are spaced for sequential locking as is known in the art. The operator tie bar 62 is suitably secured on its opposite end to the cam link 54 (see FIG. 2). Multiple openings 64 can be provided in the cam link 54 to permit easy connection to the strap 60 no matter what the size of the window frame 14 of the installation.

The above described structure is substantially similar to the prior art operator shown in U.S. Pat. No. 5,152,103. However, as previously noted, the '103 structure has heretofore presented some problem during the short transition period during closing when the drive is disconnecting from the operator portion and connecting to the locking mechanism, at which time its operation becomes indeterminate. The cam 70 and related structures described below overcome such problems.

Specifically, the cam 70 is supported for pivoting about an axis defined by a pin 72 fixed relative to the operator base 30, and includes a slot 74 therein. The cam 70 is generally disposed beneath the cam link 54, and further includes a cam member 76 projecting upwardly from the cam 70 so as to extend up into the plane of the cam link 54.

The cam link 54 includes a transverse slot 78 within which the cam member 76 is received when the sash 12 is open as shown in FIGS. 1–3 and as described in further detail hereafter. A bracket 80 is secured to the operator side of the sash 12, and includes a trip member or trigger 82 receivable in the cam slot 74 as also described hereafter. A suitable spring such as a coil tension spring 84 (shown through the broken view of the cam 70 in FIG. 3) is preferably provided to bias the cam 70 toward the position shown in FIG. 3, with the cam slot 74 facing outwardly and open to the trip member 82, and the cam member 76 seated in the cam link slot 78 (i.e., clockwise in FIGS. 3–7). It will be understood by those skilled in this art, once an understanding of the present invention is obtained, that a wide variety of biasing structures, including different types of springs, could also be used in connection with the present invention.

Functioning of the operator 10 and locking mechanism 16 is as follows.

Closing of an open window (from the position illustrated in FIGS. 1 and 2) is accomplished by rotating the handle 36 counterclockwise, which through the worm drive 34 causes the sun gear 38 to rotate clockwise. Since the cam link 54 is secured against axial motion by the engagement of the cam member 76 in its transverse slot 78, clockwise rotation of the sun gear 38 causes the planet gear 50 and connected pull link 44 to also rotate clockwise about the sun gear pin 40. As a result of this motion, the pull link 44 and drag link 48 cooperate to push the sash bracket 46 toward a closed position of the sash 12 relative to the frame 14.

Figure 4:
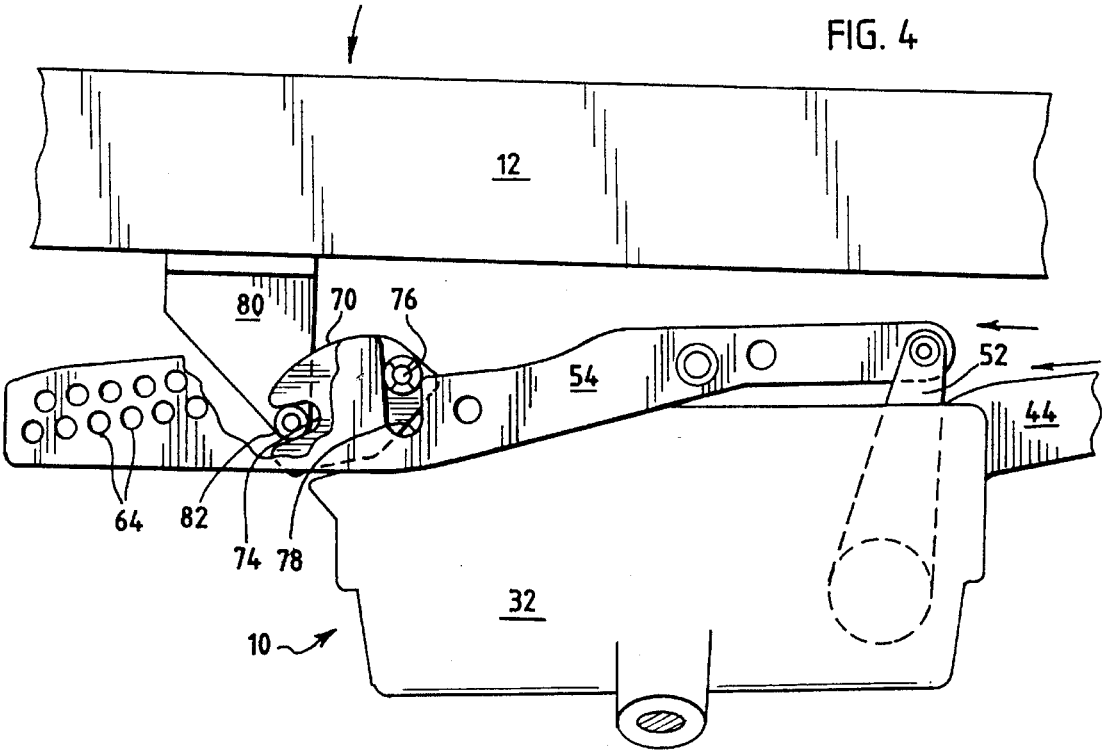
FIG. 4 is a partially broken plan view similar to FIG. 3, showing the sash and lock operator during closing.

As the window sash 12 approaches the closed position as shown in FIG. 3, the trigger 82 enters the cam slot 74 to engage the cam link 54, pivoting the link 54 counterclockwise with the cam member 76 sliding in the cam link slot 78, as illustrated in FIG. 4.

Figure 5:
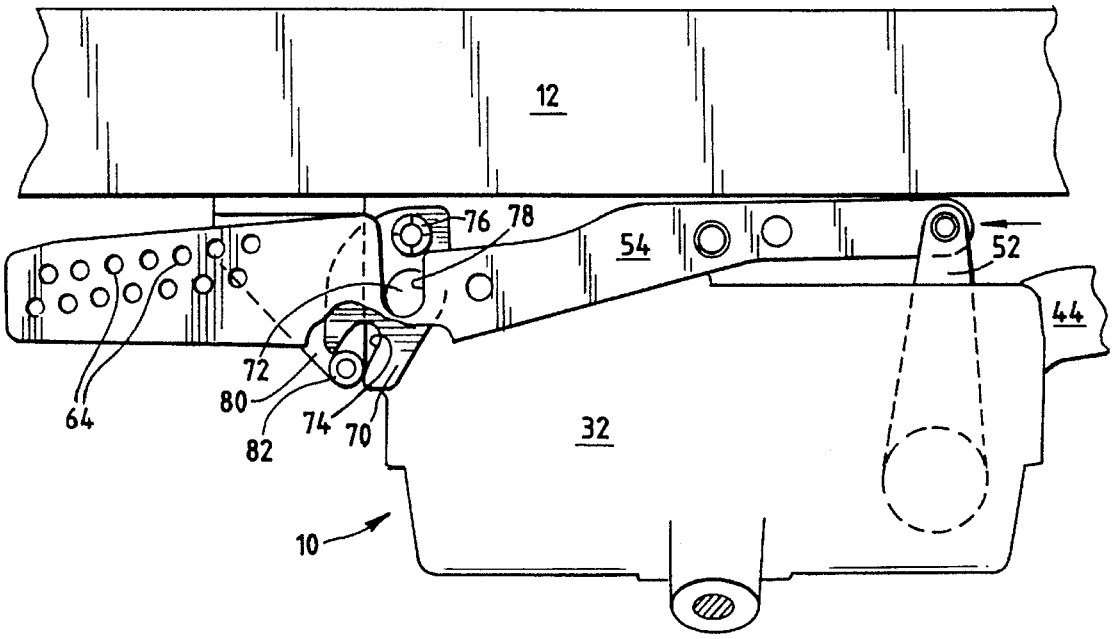
FIG. 5 is a partially broken plan view similar to FIGS. 3–4, showing the sash and lock operator after the sash has closed against the frame with the operator beginning actuation of the locking structure.

When the cam 70 has pivoted sufficiently so that the cam member 76 begins to exit the cam link slot 78, as shown in FIG. 5, the restraint against longitudinal movement of the cam link 54 (provided by the engagement of the cam member 76 in the transverse slot 78) is removed, and thus continued pivoting of the handle 36 to drive the sun gear 38 clockwise causes the planet gear 50 and connected gear arm 52 to pivot counterclockwise (further pivoting of the sun gear 38 then becoming restrained by engagement of the sash 12 with the frame 14).

Figure 6:
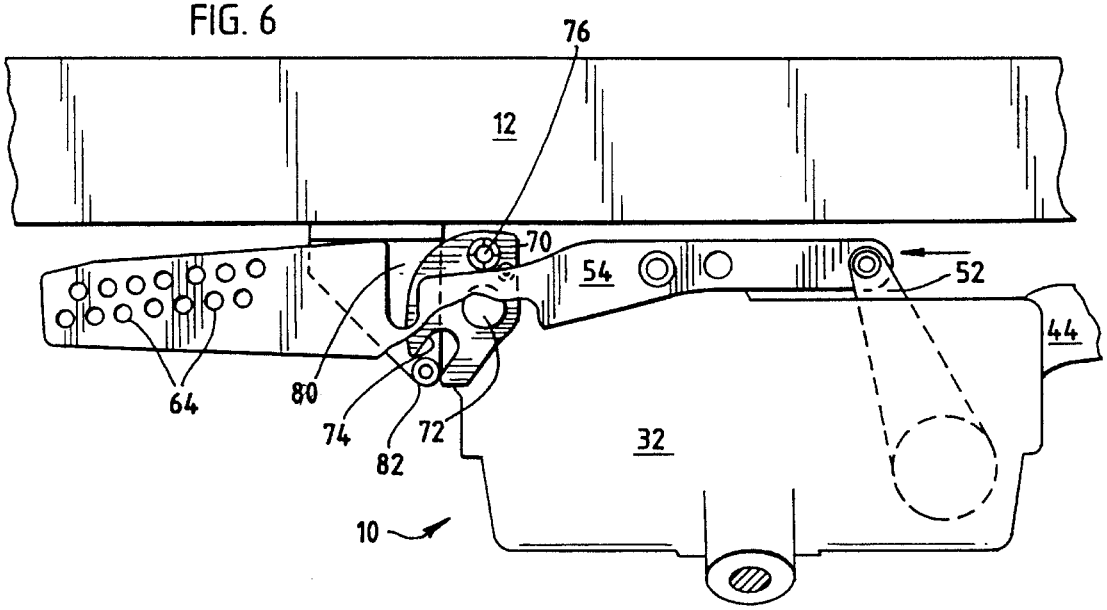
FIG. 6 is a partially broken plan view similar to FIGS. 3–5, showing the sash and lock operator during actuation of the locking structure.
Figure 7:
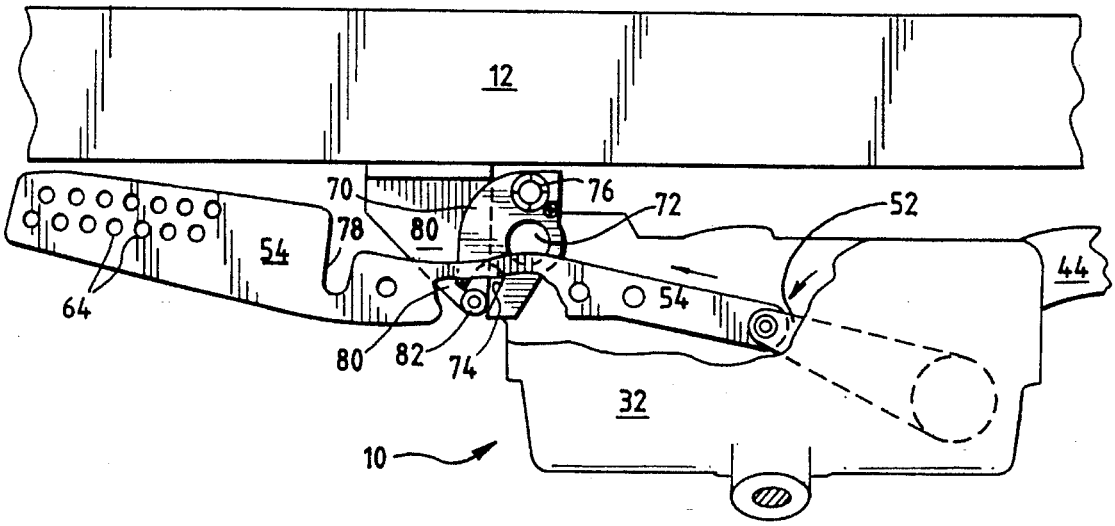
FIG. 7 is a partially broken plan view similar to FIGS. 3–6, showing the sash and lock operator after completion of locking of the locking structure.
Figure 8:
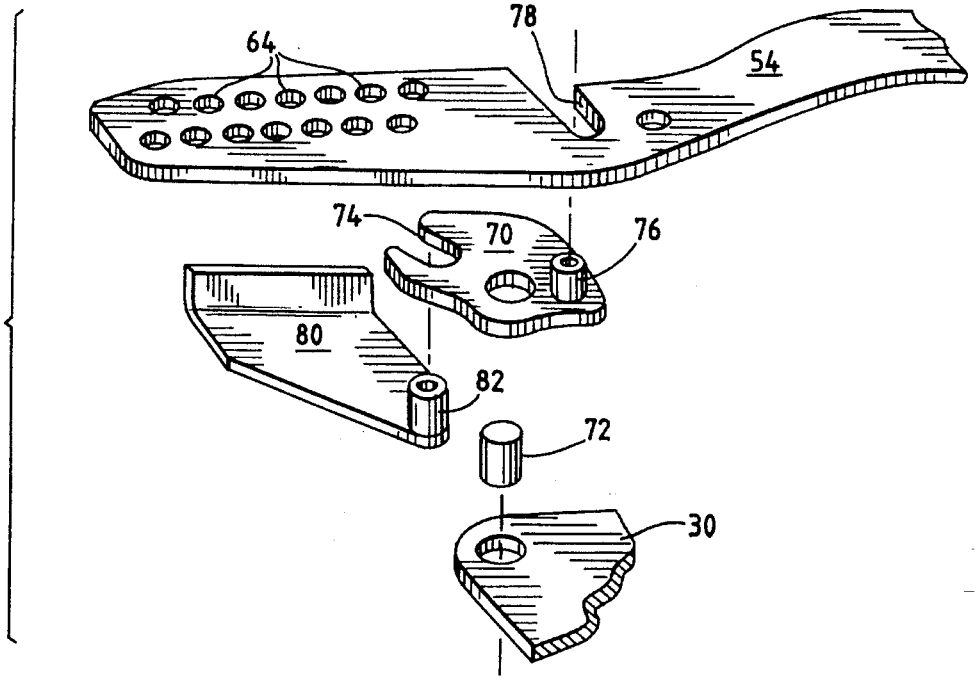
FIG. 8 is an exploded perspective view of the structure of the present invention which cooperates to automatically control operation of the sash and lock.

Pivoting of the gear arm 52 causes the connected cam link 54 and operator tie bar 62 to move to the left (from the FIG. 3 position to the FIG. 6 position). Leftward movement of the operator tie bar 62 operates through the ATC mechanism 56 to cause the lock tie bar to move up for locking by causing the keeper and roller or other suitable locking members to overlap and interengage in a well known manner.

The above described operation does not allow for an indeterminate condition of the drive, which condition could cause problems with the prior art '103 structure because. When the transition from operating the pull link 44 to operating the locking mechanism 16 occurs with the present invention, the trigger 82 secured to the sash 12 is retained in the cam slot 74. Thus, should any pressure or other force attempt to open the sash 12 when the restraint on the cam link 54 is removed, the sash 12 will be restrained against opening as a result of the trigger 82 being held in the cam slot 74. Moreover, as best shown in FIG. 6, during the full range of longitudinal motion of the cam link 54 while operating the locking mechanism 16, the cam 70 is maintained in a pivoted position (with its slot 74 positioned so as to block the trigger 82 against opening of the sash 12) by the engagement of the cam member 76 with the side of the cam link 54.

Further, opening of a locked window sash 12 is also easily and automatically accomplished by simply pivoting the handle 36 in the reverse, clockwise direction. Specifically, such pivoting of the handle 36 causes the sun gear 38 to rotate counterclockwise and thereby exert a clockwise force on the planet gear 50. Since the locking mechanism 16 initially restrains the sash 12 from opening, this force on the planet gear 50 causes the planet gear 50 and connected gear arm 52 to pivot clockwise and thereby move the cam link 54 and operator tie bar 62 to the right. This thereby acts through the ATC mechanism 56 to pull the lock tie bar down to separate the roller and keeper, whereby they no longer interfere with opening of the sash 12.

At this point, with the locking mechanism 16 unlocked, the cam member 76 is again adjacent to the cam link transverse slot 78 whereby the cam 70 is able to pivot clockwise as the cam member 76 moves back into the cam link slot 78. Such pivoting not only once again restrains the cam link 54 against movement (whereby the driving force is then transferred to bias the pull link 44 counterclockwise for opening the sash 12), but also returns the cam 70 to a position whereby its slot 74 opens out to free the trigger 82 to move out as required for opening of the sash 12.

It should be noted that the Figures illustrate the concept of the invention and are not intended to represent that the dimensions of the components need to be precisely as shown. For example, it will be understood by those skilled in the art who have acquired an understanding of the present invention that the lateral movement of the cam member 76 into and out of the cam link slot 78 is a function of the positioning of the cam axis defining cam pin 72 between the cam member 76 and the cam slot 74. Therefore, by locating the cam pin 72 relatively close to the cam slot 74 (and more particularly close to the path of the trip member 82) and relatively far from the cam member 76 (that is, by controlling the relative moment arms relative to the pivot axis), the relative lateral movement of the cam member 76 per increment of pivoting of the cam 70 can be maximized. Thus, while the cam 70 illustrated in the Figures pivots approximately 90 degrees (between FIG. 3 and FIGS. 5–6) to move the cam member 76 out of the cam link slot 78, that same movement of the cam member 76 could be accomplished by less pivoting (for example, only 35 degrees or less) by changing the relative position of the cam pivot axis between the cam member 70 and the cam slot 74. Such a result permits used of a trip member, and in particular its bracket, which project minimally from the sash 12, which is not only aesthetically desirable but also functionally so as minimizing the bracket in turn minimizes the risk of an object snagging on the bracket when the sash is open. Still further, minimizing the bracket size ensures that the sash 12 is particularly close to the frame 14 before the cam 70 is tripped to begin actuation of the locking mechanism 14, thereby best ensuring proper interlocking of the keepers and rollers on the frame and sash when actuation does occur. In short, it should be understood that it is within the scope of the present invention to use a cam configured differently than the example shown in the Figures.

The operator 10 thus functions ideally by simply requiring a person to turn a handle which automatically operates to control movement of the sash 12 and the locking mechanism 16. Since different operations are not required of the person to control the different movements, there is no risk that the person will inadvertently fail to lock the sash 12. Further, since a single drive input is used to accomplish both sash movement and locking, the operator 10 of the present invention is particularly well suited for the increasingly more common installations using electric motor drives controlled remotely. That is, not only does the structure permit for the use of a single motor, rather than requiring separate motors for sash movement and locking, but it does not present the risk of potentially improper operation (e.g., failing to lock properly) which almost certainly would not be recognized by a person controlling operation remotely.

Still further, this structure presents no danger of damaging the frame 14, sash 12, or operator such as can occur with separate operator and lock controls, for example when a person tries to forcing the operator to open a window which is, unknown to the person, locked against opening.

The operator 10 of the present invention also presents no risk of the drive operation becoming indeterminate and perhaps failing during closing and locking.

Moreover, this ideal operation is accomplished by a structure which can be inexpensively manufactured and installed, with installation of the operator being centrally on the frame for easy access for manual operation. In fact, the space requirements of the operator 10 are similar to those of other window operators on the market, so that a wide variety of aesthetically pleasing covers may be used with this operator.

Still other aspects, objects, and advantages of the present invention can be obtained from a study of the specification, the drawings, and the appended claims.

I claim:

1. In a window operator and lock structure for controlling a window sash relative to a window frame including a drive input securable to a frame and engaging both an operator linkage securable to a window sash to effectuate motion of a secured sash relative to a frame and a lock linkage securable to a lock structure for locking a secured sash to a frame, the improvement comprising:

a generally longitudinal link in said lock linkage and movable in a generally longitudinal direction when operating a lock structure, said longitudinal link including a substantially transverse slot;

a cam pivotable about a cam axis fixable relative to a frame and including a member receivable in said link slot to block operation of said lock linkage;

means associated with a secured sash for engaging said cam when a secured sash is closed against a secured frame to pivot said cam in a first direction to move said cam member clear of said link slot; and means for blocking said engaging means from moving toward opening of an associated secured sash when said cam member is clear of said link slot.

2. The improvement of claim 1, further comprising means for biasing said cam in a direction opposite said first direction.

3. The improvement of claim 1, wherein said means for blocking said engaging means comprises means for blocking said cam against pivoting in a direction opposite said first direction when said cam member is clear of said link slot wherein said cam blocks said engaging means from moving toward opening an associated secured sash when said cam is positioned with the cam member clear of said link slot.

4. The improvement of claim 3, wherein said cam blocking means comprises a side surface of said longitudinal link, said side surface engaging said cam member to block pivoting of said cam in a direction opposite said first direction.

5. The improvement of claim 1, wherein said cam includes a slot receiving said engaging means when a secured sash is substantially closed against a secured frame and substantial movement of said engaging means received in said slot pivots said cam.

6. The improvement of claim 5, wherein said engaging means comprises a trip member projecting toward said cam from a secured sash, said trip member engaging said cam when an associated secured sash is closed against a secured frame.

7. An operator and locking mechanism, comprising:

an operator linkage between a window frame and a sash for controlling movement of a sash relative to a window frame;

a locking structure securable to a window frame for locking a sash relative to a window frame when closed thereagainst;

a locking linkage for controlling operation of the locking structure;

a drive operably connected to both said operator linkage and said locking linkage;

means for securing said lock linkage against operating said locking structure;

means for releasing said securing means in response to movement of a sash to a substantially closed position relative to a window frame;

means for restraining a substantially closed sash relative to a window frame whenever said securing means is released.

8. The mechanism of claim 7, further comprising means for biasing said securing means against operation of the releasing means.

9. In a window operator and lock structure for controlling a window sash supported by a hinge for pivotal motion relative to a window frame including a drive gear rotatable about a drive axis and engaging a planet gear rotatable about its axis and pivotable about the drive axis, a hinge linkage pivotable about the drive axis with the planet gear and securable to a window sash to effectuate pivotal motion of a secured sash relative to a frame when said planet gear and linkage are pivoted about the drive axis, means securable to said frame for selectively locking the sash to a secured frame, the improvement comprising:

a lock linkage between said locking means and said planet gear whereby rotation of said planet gear about its axis moves said linkage to selectively operate said locking means, said lock linkage including a longitudinal link with a substantially transverse slot;

a cam pivotable about a cam axis fixable relative to a frame and including a member receivable in said link slot;

means for biasing said cam toward pivoting said cam member into said link slot whereby said cam member blocks operation of said lock linkage;

means associated with a secured sash for engaging said cam when a secured sash is closed against a secured frame to pivot said cam in a first direction to move said cam member clear of said link slot; and means for blocking said engaging means from moving toward opening of an associated secured sash when said cam member is clear of said link slot.

10. The improvement of claim 9, wherein said means for blocking said engaging means comprises means for blocking said cam against pivoting in a direction opposite said first direction when said cam member is clear of said link slot wherein said cam blocks said engaging means from moving toward opening an associated secured sash when said cam is positioned with the cam member clear of said link slot.

11. The improvement of claim 10, wherein said cam blocking means comprises a side surface of said longitudinal link, said side surface engaging said cam member to block pivoting of said cam in a direction opposite said first direction.

12. The improvement of claim 10, further comprising means for biasing said cam in a direction opposite said first direction.

13. The improvement of claim 9, wherein said cam includes a slot receiving said engaging means when a secured sash is substantially closed against a secured frame and substantial movement of said engaging means received in said slot pivots said cam.

14. An operator and locking mechanism, comprising:

an operator linkage between a window frame and a sash for controlling movement of a sash relative to a window frame;

a locking structure securable to a window frame for locking a sash relative to a window frame when closed thereagainst;

a locking linkage for controlling operation of the locking structure;

a drive operably connected to both said operator linkage and said locking linkage;

means for automatically restraining one linkage for selective driving of the other linkage during operation of the mechanism, including a generally longitudinal link in said lock linkage and movable in a generally longitudinal direction for controlling the locking structure, said longitudinal link including a substantially transverse slot, a cam pivotable about a cam axis fixable relative to a frame and including a member receivable in said link slot to block operation of said lock linkage, means associated with a secured sash for engaging said cam when a secured sash is closed against a secured frame to pivot said cam in a first direction to move said cam member clear of said link slot; and means for blocking said engaging means from moving toward opening of an associated secured sash when said cam member is clear of said link slot.

15. The mechanism of claim 14, wherein said means for blocking said engaging means comprises means for blocking said cam against pivoting in a direction opposite said first direction when said cam member is clear of said link slot wherein said cam blocks said engaging means from moving toward opening an associated secured sash when said cam is positioned with the cam member clear of said link slot.

16. The mechanism of claim 15, wherein said cam blocking means comprises a side surface of said longitudinal link, said side surface engaging said cam member to block pivoting of said cam in a direction opposite said first direction.

17. The mechanism of claim 15, further comprising means for biasing said cam in a direction opposite said first direction.

18. The mechanism of claim 14, wherein said cam includes a slot receiving said engaging means when a secured sash is substantially closed against a secured frame and substantial movement of said engaging means received in said slot pivots said cam.

19. The mechanism of claim 18, wherein said engaging means comprises a trip member projecting toward said cam from a secured sash, said trip member engaging said cam when an associated secured sash is closed against a secured frame.

20. An operator and locking mechanism for controlling a window sash relative to a window frame, comprising:

a window sash supported relative to a window frame;

an operator linkage between said window frame and said sash for controlling movement of the sash relative to the frame;

a locking structure securable to the frame for locking the sash relative to the frame when closed thereagainst;

a locking linkage for controlling operation of the locking structure;

a drive operably connected to both said operator linkage and said locking linkage;

means for automatically restraining one linkage for selective driving of the other linkage during operation of the mechanism, including a generally longitudinal link in said lock linkage and movable in a generally longitudinal direction for controlling the locking structure, said longitudinal link including a substantially transverse slot, a cam pivotable about a cam axis fixable relative to the frame and including a member receivable in said link slot to block operation of said lock linkage, means associated with the sash for engaging said cam when the sash is closed against the frame to pivot said cam in a first direction to move said cam member clear of said link slot; and means for blocking said engaging means from moving toward opening of the sash when said cam member is clear of said link slot.

21. The mechanism of claim 20, wherein said means for blocking said engaging means comprises means for blocking said cam against pivoting in a direction opposite said first direction when said cam member is clear of said link slot wherein said cam blocks said engaging means from moving toward opening an associated secured sash when said cam is positioned with the cam member clear of said link slot.

22. The mechanism of claim 21, wherein said cam blocking means comprises a side surface of said longitudinal link, said side surface engaging said cam member to block pivoting of said cam in a direction opposite said first direction.

23. The improvement of claim 21, further comprising means for biasing said cam in a direction opposite said first direction.

24. The mechanism of claim 20, wherein said cam includes a slot receiving said engaging means when a secured sash is substantially closed against a secured frame and substantial movement of said engaging means received in said slot pivots said cam.

25. The mechanism of claim 24, wherein said engaging means comprises a trip member projecting toward said cam from a secured sash, said trip member engaging said cam when an associated secured sash is closed against a secured frame.

26. A window operator and lock structure for controlling a window sash supported by a hinge for pivotal motion relative to a window frame, said structure comprising:

a base mounted to the frame and supporting a sun gear for rotation about a sun gear axis;

means for drivably rotating said sun gear;

a planet gear rotatable about a planet gear axis and engaging said sun gear, said planet gear further being supported on said base for pivoting about said sun gear axis;

a first linkage pivotally secured at one end to the planet gear axis and secured at the other end to the window sash for controlling pivotal motion of the sash relative to the frame;

axially reciprocable means on said frame for selectively locking said sash to said frame; and means for controlling said locking means, including a gear arm fixedly secured to the planet gear, a cam pivotable about a fixed axis and including a member projecting therefrom, a longitudinal link having a transverse slot therein between opposite ends, said link being pivotally secured at one end to the gear arm and operably connected to said locking means at the other end whereby movement of the gear arm moves said link in a substantially longitudinal path which in part overlaps said cam, a bracket fixed relative to said sash and interlocking with said cam to pivot said cam in a first direction when said sash is substantially closed against said frame, whereby closing movement of the sash when substantially closed against said frame pivots said cam in a first direction, and means for pivotally biasing the cam in the direction opposite said first direction.

* * * * *